US006277042B1

(12) United States Patent
Lekavich

(10) Patent No.: US 6,277,042 B1
(45) Date of Patent: Aug. 21, 2001

(54) GAME PUCK WITH IMPROVED GLIDER PIN

(76) Inventor: Carl Lekavich, Ideal Design Sports Inc, 21529 Menlo Ave., Torrance, CA (US) 90502

( * ) Notice: Subject to any disclaimer, the term of this patent is extended or adjusted under 35 U.S.C. 154(b) by 0 days.

(21) Appl. No.: 09/477,431

(22) Filed: Jan. 4, 2000

Related U.S. Application Data

(63) Continuation-in-part of application No. 08/990,719, filed on Dec. 15, 1997, now Pat. No. 6,010,418, which is a continuation-in-part of application No. 08/512,759, filed on Aug. 9, 1995, now Pat. No. 5,697,858.

(51) Int. Cl.[7] ..... A63B 1/00
(52) U.S. Cl. ..... 473/588
(58) Field of Search ..... 473/588, 589; 411/338, 339, 510

(56) References Cited

U.S. PATENT DOCUMENTS

| | | | |
|---|---|---|---|
| 150,060 | 4/1874 | Lapham . | |
| 607,315 | 7/1898 | Wingard . | |
| 1,418,314 | 6/1922 | McBee . | |
| 2,201,551 | 5/1940 | Welk . | |
| 3,675,928 | 7/1972 | Gentile . | |
| 3,726,526 | 4/1973 | Radovich . | |
| 3,784,204 | 1/1974 | Felber . | |
| 4,078,801 | 3/1978 | White, Sr. . | |
| 4,111,419 | 9/1978 | Pellegrino . | |
| 4,793,769 | 12/1988 | Dolan . | |
| 5,074,696 | 12/1991 | Tanaka . | |
| 5,207,720 | 5/1993 | Shepherd . | |
| 5,275,410 | 1/1994 | Bellehumeur et al. . | |
| 5,366,219 | 11/1994 | Salcer et al. . | |
| 5,482,274 * | 1/1996 | Bellehumeur | 473/588 |

* cited by examiner

*Primary Examiner*—Raleigh W. Chiu
(74) *Attorney, Agent, or Firm*—Reising, Ethington, Barnes, Kisselle, Learman & McCulloch, P.C.

(57) ABSTRACT

A game puck including a puck body having a plurality of throughbores radially disposed therein, each receiving a diagonally split glide pin. The glide pins each have heads which protrude from each face of the puck. Each pin has a diagonally split shank defining a plurality of mating teeth and a predetermined total shank diameter when joined. Each component of the pin has an inclined toothed or serrated surface which mates with a like component, each component having a tip diameter which is substantially less than one-half of the diameter of the total shank diameter. The shank diameter when joined is less than or equal to the throughbore diameter. The shank when joined defines an engaged section having a diameter slightly greater than the throughbore diameter. Each glide pin is capable of being vertically displaced under applied pressure and collectively act as a shock absorber to dampen the fall of the puck during play.

10 Claims, 3 Drawing Sheets

GAME PUCK WITH IMPROVED GLIDER PIN

CROSS-REFERENCE TO RELATED APPLICATION

This application is a continuation-in-part of application Ser. No. 08/990,719 filed Dec. 15, 1997, now U.S. Pat. No. 6,010,418, which is a continuation-in-part of application Ser. No. 08/512,759 filed Aug. 9, 1995, now U.S. Pat. No. 5,697,858.

BACKGROUND OF THE INVENTION

1. Field of the Invention

This invention relates generally to projectiles having improved glide pins. More particularly, the present invention pertains to a puck having a plurality of apertures, each containing a bipartite pin, wherein each mating component of the pin includes a shank having an angularly inclined toothed surface, which when joined within a puck aperture forms a glide pin.

2. Description of the Prior Art

In-line skates have inspired renewed interest in playing street hockey. Similar to ice hockey, the players drive a puck into an opposing team's goal to score points. Unlike in ice hockey, the puck typically does not slide as easily along a street hockey playing surface, typically cement or asphalt, as it would on ice. Players of street or roller hockey often must retrace their paths to reclaim the projectile, slowing the game and making it less enjoyable. The puck oftentimes flips upon its edge and rolls across the playing surface rather than playing flat, or sliding along on one of its two faces. Another problem with using a conventional street hockey puck to play roller hockey is that it tends to rebound off objects with high energy at unpredictable trajectories. As roller hockey technology improves, players become less tolerant of inadequate playing characteristics exhibited by conventional hockey pucks. A need exists for a puck that glides easily on a street or court hockey playing surface, tends to play flat, provides low-energy rebound action, provides long pin-life and discourages rolling on its edge.

These advantageous properties of a puck used to play street hockey are largely dependent on the glide pins used during the manufacturing process. Due to the high shear forces exerted upon the puck during play, inadequately designed pins often cause pin heads to be sheared off and fall out, thus destroying the life and usefulness of the puck. Surface wear further causes the pin heads to wear down and cause the pin to fall out of the puck. However, manufacturing concerns, such as cost and speed of manufacturing each puck, act against the use of quality pins.

In many manufacturing processes, a molding process is used to inject hot, fluid plastic into a mold which provides a plurality of predetermined diameter apertures into the puck, each aperture being sized to exact tolerances to receive a pin shank. The head of the pin, whether recessed into the surface of the puck or not, resides above the general plane of the puck body, thereby elevating the puck to permit it to glide over surfaces with high coefficients of friction, such as a concrete surface. However, several factors cause problems to the successful insertion of such pins into the puck, which in turn effect the useful life and shear force resistance of the pins within the puck.

First, as the plastic of the puck body cools after injection, the plastic shrinks, thus causing the aperture formed to receive the pin to increase. This provides an potential advantage to a pin which can alter its diameter. For purposes of being inserted into a puck, a reduced diameter pin is desired. However, after final assembly, a pin having a snug fit within the aperture, and thus a diameter as close to that of the aperture, to grip the puck, is also advantageous.

These conflicting advantages present manufacturing problems. If the pin can be inserted early enough in the process, the shrinkage of the plastic body results in a loss of gripping force upon the pin and increases the chance of the pin being lost over the life of the puck. However, during the shrinking process, the plastic is subject to damage by an improperly inserted pin, such as jabbing by a sharp object such as the pin's tip. Thus, unless a pin can be inserted without contact through the mouth of the aperture, the risk of a damaged puck is high, and consequently the process is slowed down until a threshold temperature is reached where a pin can be inserted without fear of damage.

Even then, a pin which must be inserted into a predetermined diameter aperture cannot have a shank diameter of greater than or closely approaching the aperture diameter and provide an expectation of an improved grip within the aperture against the wall of the puck body. None of the pucks in the prior art, nor bipartite or split pins known in the art, are properly configured to serve the needs of the puck manufacturer. Thus, a need for an improved glide pin is seen.

Several types of game pucks are described in the patent literature. Unfortunately, the devices described in the prior art do not predispose a puck to the above described requirements.

Most notably, U.S. Pat. No. 5,275,410, issued Jan. 4, 1994, to Bellehumeur et al., and U.S. Pat. No. 5,482,274, issued Jan. 9, 1996 to Bellehumeur, describe a puck for use on a non-ice surface. The puck includes a solid core having an upper face, a lower face and an annular surface with a plurality of annular slots and throughbores radially diverged therethrough. The slots provide spring means that deform on impact. Stainless steel or polyurethane runners, i.e. glide pins, are received in each throughbore, each having a head protruding above each face. One embodiment of a runner shows it formed in two pieces. In particular, as shown in FIG. 17 of the '410 patent, one piece has an axial bore with interior annular teeth that engage with the exterior annular teeth of the second piece inserted therein. However, such pin has a fixed diameter determined by one component part, and has an axial arrangement that prevents it from being used as described above. In essence, the throughbore will reach a predetermined diameter after cooling and only then can the runner be safely inserted into the throughbore without damaging the sidewalls of the throughbore. Moreover, the pin must be inserted in nearly perfect coaxial and concentric alignment with the throughbore, and will still not derive the benefit of an tight fit.

Other less relevant pucks include, for example, U.S. Pat. No. 3,675,928, issued Jul. 11, 1972, to Salvatore A. Gentile, describes an impact safety game puck. The apparatus includes a solid core with a peripherally-disposed annular chamber. A second embodiment includes a thin disk having two faces and a wide, peripherally-disposed annular chamber, defining bowl-shaped cavities in each face of the disk.

U.S. Pat. No. 3,726,526, issued Apr. 10, 1973, to Leroy N. Radovich, describes a multi-purpose game puck. The device includes a solid core having an upper face, a lower face and an annular surface. The device has a central recess and a plurality of indented surfaces radially diverged in each face.

U.S. Pat. No. 3,784,204, issued Jan. 8, 1974, to Julius Felber, describes a hockey puck. The apparatus includes a solid core having an upper face, a lower face and an annular surface. The apparatus has central recesses in each face. The apparatus includes a plurality of spherical rollers radially diverged and slidingly maintained on each face.

U.S. Pat. No. 4,793,769, issued Dec. 27, 1988, to Michael Dolan, describes a hockey puck having a solid core with an upper face, a lower face and an annular surface. The device includes a plurality of ball bearings, radially diverged and slidingly received in the core. The ball bearings protrude through each face.

U.S. Pat. No. 5,207,720, issued May 4, 1993, to Charles G. Shepherd, describes a hockey puck device having a first housing and a second housing which threadingly interengage to define a cavity. Gage means are disposed within the cavity for measuring impact forces.

U.S. Pat. No. 5,366,219, issued Nov. 22, 1994, to William Salcer et al., describes a hockey puck which includes an insert member over which plastic material is molded. The finished device has an upper face, a lower face and an annular surface. The insert has runners that protrude through and are radially diverged about the periphery of each face. The runners are constructed from nylon, possibly blended with "Kevlar™."

Other pucks failing to show the pin of the present invention include U.S. Pat. No. 4,111,419 issued to Pellegrino, U.S. Pat. No. 5,207,720 issued to Shepherd, and U.S. Pat. No. 4,078,801 issued to White, Sr.

Of the bipartite pins known in the prior art, U.S. Pat. No. 5,074,696 issued to Tanaka is notable in its disclosure of securing pairs of fasteners, each with engagement teeth. However, this fastener assembly would not be suitable in the present application for a plastic molded puck. First, the teeth of the Tanaka fastener are aligned substantially along a single plane substantially perpendicular to a central axis passing concentrically through the head of the pin, as well as nearly parallel to the peripheral wall of the shank. Thus, the tip of the pin is almost one half of the total diameter of the shank when joined together. Such a configuration teaches away from the structure of the present invention. Moreover, Tanaka fails to describe or teach the use of a reduced tip size as an important factor in the insertion of quality runners or glide pins during the manufacturing process of a puck to increase the useful life of the puck.

Other patents describing pins for binding loose leaves which suffer from the above described and other disadvantages include U.S. Pat. No. 2,201,551 issued to Welk and U.S. Pat. No. 1,418,314 issued to McBee. An toothed insulator is shown in U.S. Pat. No. 607,315 issued to Wingard, and an inclined split bolt is shown in U.S. Pat. No. 150,060 issued to Lapham.

The above shortcomings of the prior art demonstrate a need for a game puck having an improved glide pin. None of the above references, taken alone or in combination, are seen as teaching or suggesting the presently claimed game puck.

SUMMARY OF THE INVENTION

The present invention overcomes the limitations of the above inventions by providing a game puck shell having a plurality of unique glide pins. The shell has a plurality of throughbores radially disposed and interposed between the upper and lower faces of the puck. A two-component glide pin is received in each throughbore. Each component of the glide pin has teeth that interengage with its mating component when the glide pin is assembled in a throughbore to define a section having a diameter slightly greater than the diameter of the throughbore. Thus, each pin component has its own longitudinal axis which does not align with that of its mating component when joined. Each mating pin component is provided with a head, a tip and a diagonally split shank having an inclined toothed or serrated surface. The diameter of the shank adjacent each head is equal to or slightly less than the throughbore diameter. The diameter of each tip is substantially less than one-half of the shank diameter. Thus when a pair of pin components are abutted at the tip, a reduced diameter is defined which approximates one half or less of the each shank diameter. This tip diameter permits ready insertion of a pin component into each mouth of a puck throughbore. As the tip of each mating component are driven pass one another in opposing directions, an engaged pin section is defined in which the longitudinal axes of the mating pin components are not coextensive and the diameter of this engaged section slightly exceeds the diameter of the throughbore to the extent of micrometer tolerances.

This slightly oversized pin section may locally bulge the material about the receiving throughbore and generate annular flat spots between neighboring pins. While the puck body surrounds or encompasses each glide pin, it does not hold the mating pin components together within the throughbore. Rather, each pin component is held in the puck by its mating component. In fact, each glide pin is capable of being vertically displaced, ever so slightly, under applied pressure and collectively act as a shock absorber to dampen the fall of the puck during play. Each glide pin has a first head that protrudes beyond the upper face and a second head that protrudes beyond the lower face. The present puck exhibits superior playing characteristics and traverses the street hockey playing surface with minimal friction on the heads of the glide pins.

It is therefore an object of the present invention to provide a game puck for use on a non-ice surface that exhibits improved playing characteristics.

It is another object of the present invention to provide a game puck having improved split glide pins suited to the manufacture of a puck by molding.

A further object of the invention is to provide a game puck having glide pins with heads that contact the playing surface to enhance the sliding and dampening characteristics of the puck.

An additional object of the invention is to provide a game puck having glide pins with inter-engaging teeth that self align when received in the game puck.

Yet a further object of the invention is to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features of the invention consistently throughout the attached drawings.

DETAILED DESCRIPTION OF THE PREFERRED EMBODIMENTS

Figure 1:
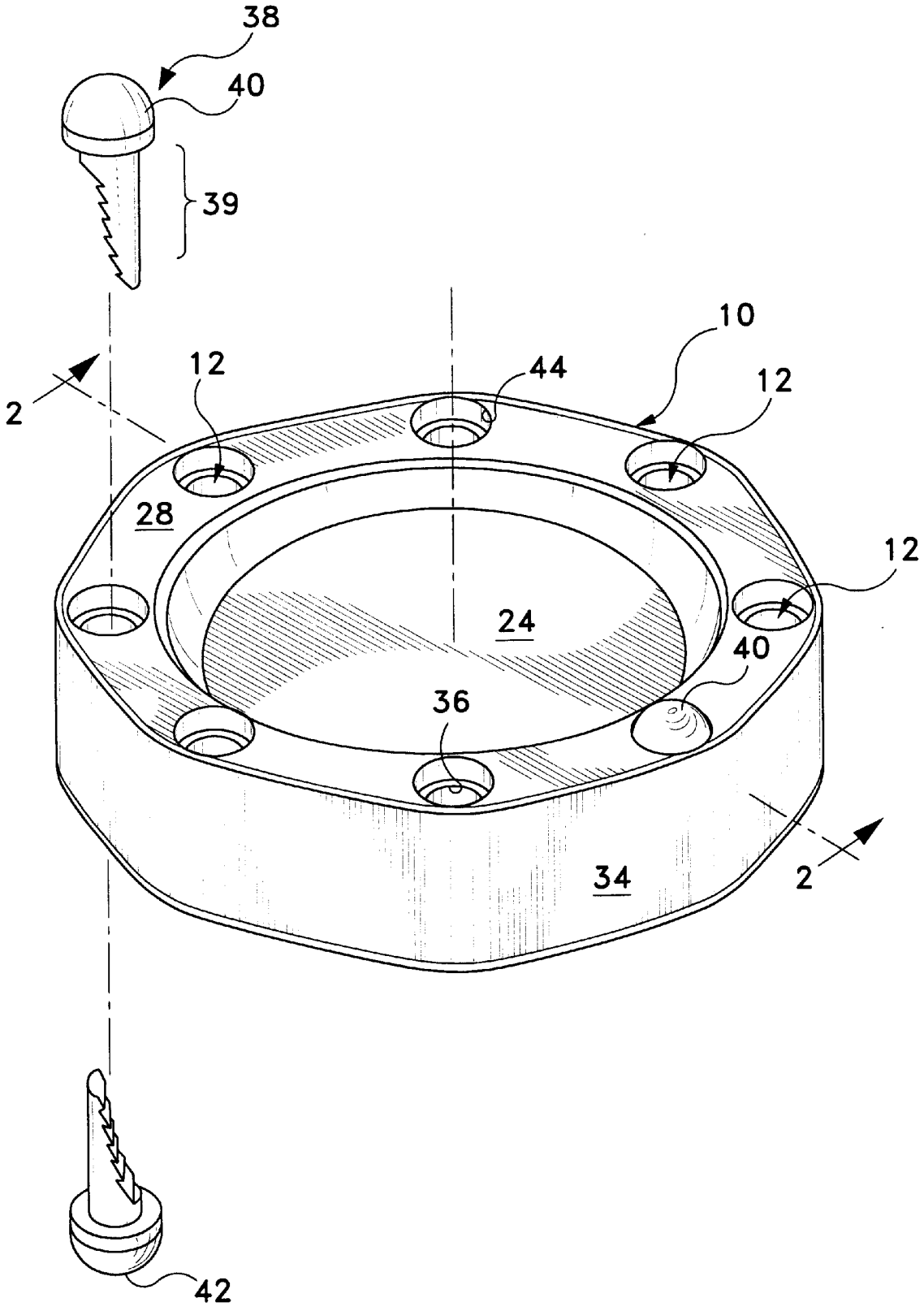
FIG. 1 is a partially exploded, perspective view of a game puck with a split glide pin according to the present invention.
Figure 2:
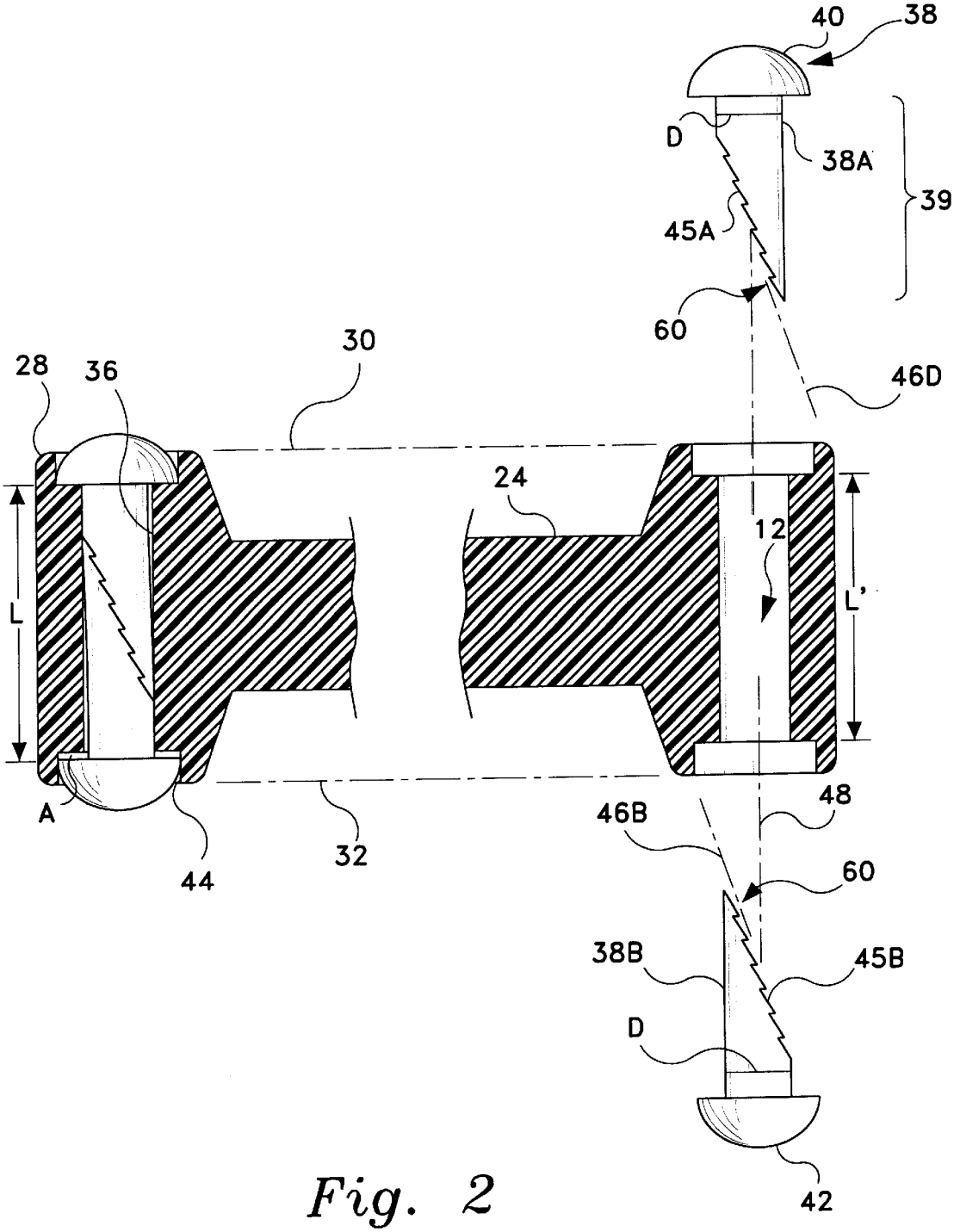
FIG. 2 is a cross-sectional view of the present invention taken along lines 2—2 of FIG. 1.

Referring to FIGS. 1 through 3, the invention includes a disc-shaped puck body 10 having a plurality of throughbores or apertures 12. The puck body 10 is constructed from polyvinylchloride (PVC) formulated with high- and low-temperature plasticizers. The plasticizers maintain relatively constant durometer within the PVC between temperatures of 50° through 100° Fahrenheit (F). Maintaining constant durometer in a material through a range of temperatures provides desirable constant density, deflection and expansion properties. These consistent properties provide street hockey players with a puck having predictable playing characteristics. A puck having predictable playing characteristics reduces the variables players must master. Limiting the number of variables permits players to improve their skills rapidly.

In FIG. 1, a representative game puck body 10 is shown with a glide pin 38 being received in the throughbore 12. The puck body 10 includes a shell 28 that circumscribes and joins a center film 24. Preferably, the puck body 10, center film 24 and shell 28 define an upper face 30, a lower face 32 and an annular surface 34. When force is applied to the shell 28, the shell 28 urges the center film 24 to compress. However, the center film 24 is purposed at absorbing impact and providing the brunt of the rebound action.

Preferably, the puck body 10, center film 24 and shell 28 are integrally constructed. Integral construction permits large-scale manufacture of the present puck by injection molding that is inherently less expensive than production and assembly of multiple parts. The shell 28 may be fabricated such that it deforms on impact, as described in U.S. Pat. No. 5,275,410, discussed supra.

The shell 28 has a plurality of throughbores 12, defining an interior wall 36, the throughbores 12 radially spaced about and interposed between the upper face 30 and lower face 32 of the puck. A glide pin 38 is received in each throughbore 12. Preferably, each throughbore 12 has a diameter of about 0.245 inch±0.002.

Figure 3A:
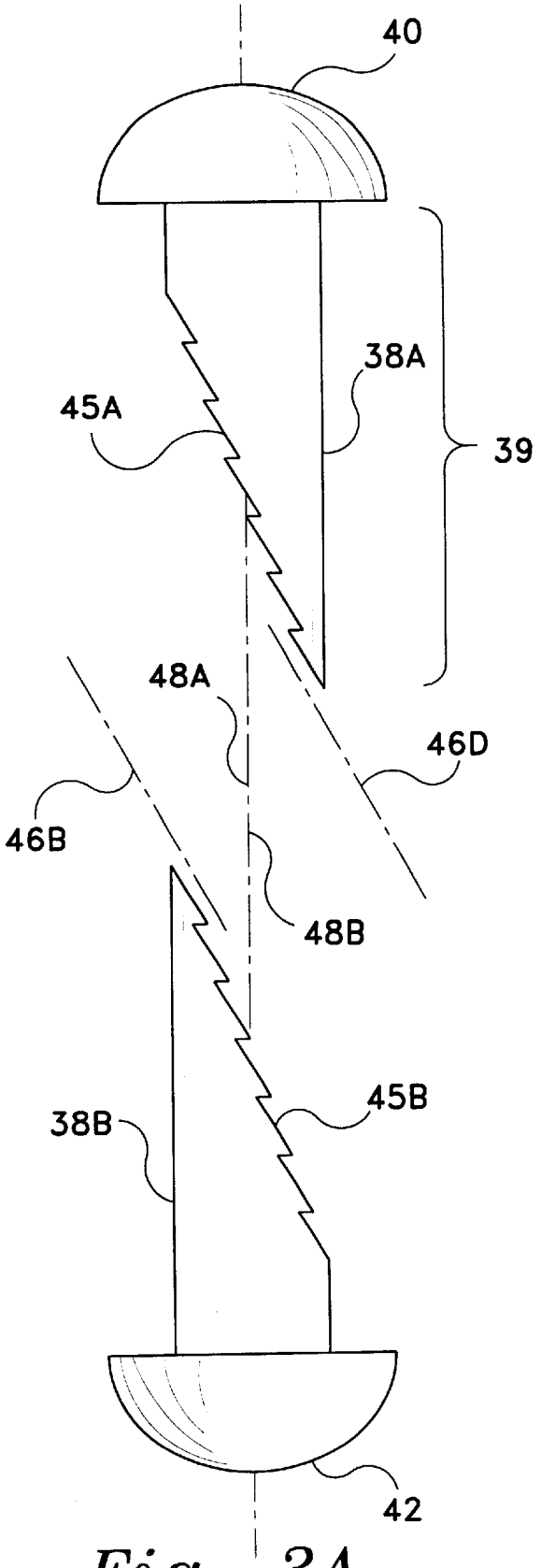
FIG. 3A is a side elevational view of a glide pin according to the present invention showing the longitudinal axis of each mating component when separated.
Figure 3B:
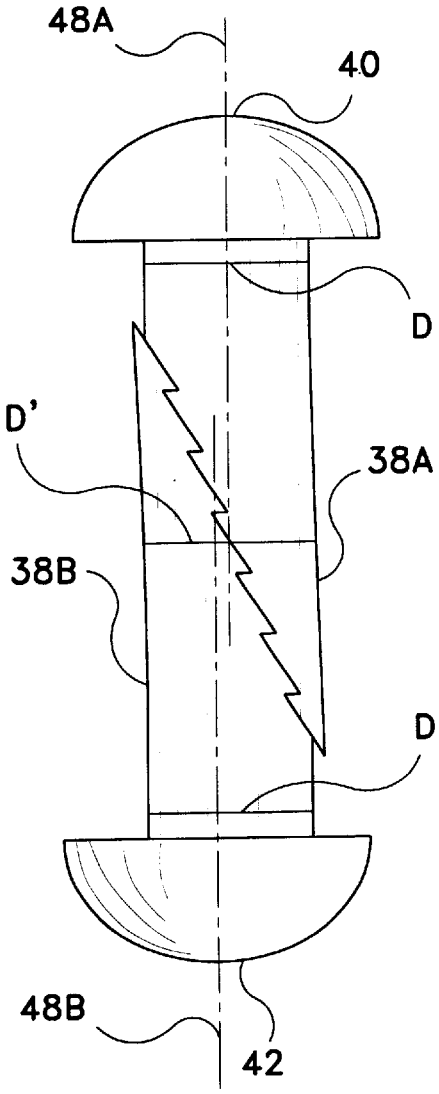
FIG. 3B is a side elevational view of the glide pin of FIG. 3A showing the longitudinal axis of each mating component when joined together.

As shown in FIGS. 2, 3A and 3B, the glide pin 38 is a split pin of bipartite construction. The pin 38 is shown having a first head 40, which protrudes beyond the upper face 30, and a second head 42, which protrudes beyond the lower face 32. Each head 40 and 42 has a larger diameter than the throughbore 12 receiving the glide pin 38, to assure that the glide pin 38 does not pass through the puck. Each head 40 and 42 is shown received in a counterbore 44 at each end of each throughbore 12. The counterbores 44 lend stability to the glide pin 38 and lessen the effect of the shear force on the pin 38. Moreover, were the glide pin 38 not thus securely held in place, the pin would vibrate as the puck traverses a coarse playing surface, dissipating the kinetic energy of the puck and reducing the desired play speed.

The glide pin 38 is constructed from hard thermal plastic polymer with a durometer within the range of 70 to 100 shore on the "D" scale. Additionally, the polymer includes 5 to 40 percent fiber fill to enhance stiffness as is well known in the art of polymerization. Material having this durometer generally has enhanced lubricity, a characteristic which is exploited to considerable benefit. The enhanced lubricity reduces the coefficient of friction between the glide pin 38 and a playing surface, providing faster play. The plastic also allows a glide pin 38 to be replaced by clipping off one of the heads 40 or 42 and inserting a new glide pin 38. Glide pins 38 having different durometers and lubricity characteristics may be inserted in each throughbore 12 to provide the puck a variety of friction coefficients for different playing surfaces.

As best seen in FIGS. 2, 3A and 3B, the glide pin 38 is shown formed from two shank members, 38A and 38B, joining heads 40,42, respectively. The pin 38 is thus provided having a diagonally split shank 39 defining a plurality of mating teeth 45A,45B and a predetermined total shank diameter when the component parts 38A,38B are fully joined. The predetermined total shank diameter, represented by line D, is defined by the cylindrical section adjacent heads 40 and 42 when the component parts 38A,38B are joined within each throughbore 12. Shank diameter D may be equal to or slightly less than the throughbore diameter and is preferably about 0.240 inch±0.005.

Each mating shank member has an inclined toothed or serrated surface which mates with its mating component. Any style or shape of tooth may be chosen, such as a plurality of teeth forming a serrated incline, or, in the alternative, a serpentine incline. The serrated incline being preferred. Each shank member 38A and 38B has teeth 45A and 45B, respectively, disposed on planes 46D and 46B, respectively, at a predetermined angle relative to its own longitudinal axis 48A,48B. The predetermined angle is preferably in the range of 5 to 20 degrees from each longitudinal axis . The teeth 45A and 45B, when the planes 46D and 46B are urged to mate, interengage, permanently securing the glide pin 38 in its respective throughbore 12. Each shank member tapers along its imaginary incline plane 46D or 46B from proximate the head 40 to a tip end 60 including a first tooth. Each shank member 38A,38B has a maximum tip diameter through the tooth which is substantially less than one-half of the total shank diameter D. The preferred diameter of tip end 60 is less than one-third of the total shank diameter D.

Thus, in the preferred embodiment, when a pair of shank members 38A,38B are abutted at the tip end, a reduced diameter is defined which approximates two thirds or less of the total shank diameter. This diameter permits insertion of a shank member 38A,38B into each mouth of a puck aperture 12 so that, during joinder of the shank members 38A,38B, as the tip ends 60 abut, a large margin of space between wall 36 and the tip end 60 occurs. This avoids insertion damage at the mouth of the aperture.

Moreover, as the tip ends 60 are driven past one another in opposing directions, an engaged pin section is defined in which the longitudinal axes 48A,48B of the respective mating shank members 38A,38B are not coextensive as shown in FIG. 3B. The diameter D' (FIG. 3B) of this engaged section slightly exceeds the diameter of the throughbore to the extent of micrometer tolerances to further add holding strength to the pin within the puck. This engaged section diameter D' is preferably about 0.250 inch±0.002.

While the interior wall 36 of the throughbore 12 surrounds each glide pin 38, it does not hold the mating shank members 38A,38B together. Rather, each glide pin 38 is held in the puck by its mating shank members 38A,38B. Moreover, each glide pin 38 is capable of being vertically displaced, ever so slightly, under applied pressure. As shown in FIG. 2, the length L of the engaged shank members 38A,38B as measured from the base of the first head 40 to the base of the second head 42 is slightly greater than the length L' of the throughbore 12, as measured between counterbores 44. This creates an area i.e. gap A to allow vertical micro movement, approximately 0.002 to 0.010 inch, of each glide pin 38, which collectively act as a shock absorber to dampen the fall of and increase the playing characteristics of the puck.

While the tip ends 60 of pin shanks 38A and 38B are shown to be inclined, it is understood that they may also be blunted as disclosed in aforementioned U.S. Pat. No. 6,010,418, which is incorporated herein by reference. An advantage to such an inclined tip 60 is that kinetic energy can be dissipated in the manner also similar to that of a shock absorber by allowing displacement of the shank members 38A,38B in the micrometer range. The fit provided by the split pin 38 against the throughbore wall 36 prevents excessive outward and inward pressure on the pin as well as the throughbore wall to allow micro displacement of the pin and prevent binding the shank members 38A,38B.

A further characteristic of each tooth 45A,45B which provides an added advantage to the manufacture of plasticized PVC pucks is flexibility. Each tooth is preferably dimensioned and configured to a thin enough size where the material properties of each tooth permits flexing sufficient to allow the passage of opposing teeth, thus limiting excessive outward displacement of the circumferential wall of the pin shanks 38*a*,38*b*, yet resilient enough to retain its original shape to engage an opposing tooth.

This feature is particularly important in the manufacture of plasticized PVC pucks. As noted above, the throughbore 12 is prone to enlargement by cooling of the plasticized PVC, and thus an optimal fit may be difficult to achieve with prior art pins. Moreover, the molecular characteristics of plasticized PVC during the curing process also cause shrinkage, irrespective of cooling, contributing to the problem. Finally, the plasticized PVC before the final cure state has nearly no rebound properties, i.e. no resilient memory, which can result in an enlarged throughbore! by virtue of the mechanical forces exerted upon wall 36 during the insertion of a pin 38. In other words, the hole is stretched and cannot return to its intended diameter.

The teeth 45A,45B, as a whole serrated incline, should be sufficiently small-sized and flexible to prevent exceeding the threshold force which permanently enlarges the throughbore due to the non-resilient properties of the plasticized PVC at a given temperature. In commercial production of pucks using such pins having small and flexible teeth, optimum tolerances between the pin shank and aperture wall have been achieved.

Regarding the method for constructing the present game puck, reference is made to aforementioned U.S. Pat. No. 6,010,418, incorporated by reference. The method includes providing a mold having a cavity defining the outer surface of a puck. The mold includes a predetermined number of casting puck bodies around which the injected material must flow.

The method includes the step of injecting material into the mold through a centrally-disposed fan gate. Typically, prior art pucks would be produced in molds having laterally-disposed gates. Hot plastic material flows from the laterally-disposed gates through the mold cavity and around the casting puck bodies therein. As the plastic flows, it cools. By the time the plastic material has reached the farthest point from the gate, the material has begun to set. This is significant in two ways.

First, the material delivered into the mold has a density proximal to the gate significantly variant from that of the material distal to the gate. Nonuniform density introduces imbalance and thermally-sensitive concentricity. Imbalance occurs when a body has nonuniform mass. A puck constructed of material with lesser and greater density portions dichotomously ordered has nonuniform mass. Thermally-sensitive concentricity occurs when, as the temperature of the body increases, the body expands in a nonuniform manner and goes out of round. Bodies having anisotropic density characteristics expand non-uniformly as temperature increases.

Second, casting puck bodies force flowing plastic material to part and form two streams. Theoretically, the streams are supposed to merge, forming a uniform mass. However, with respect to casting puck bodies distal to the gate, the plastic material has cooled considerably prior to its bifurcation. Rather than the streams merging once past the casting puck body, the skins of each stream may adhere, forming a cold joint. Cold joints introduce anisotropic characteristics in the molded body.

A player may realize the effects of imbalance, non-concentricity and/or anisotropically-diverged cold joints in the form of puck wobble, skewed trajectory and unpredictable rebounding. A cold joint also tends to fail, introducing a stress node along which the puck may crack. The present invention, by providing for a central fan gate, has a shorter distance over which to flow than a mold constructed with laterally-disposed gate. The shorter distance reduces the density discrepancies within the puck. Centrally-disposed fan gate also reduce the opportunities for cold joints to form. Even if cold joints did form, they would be isotropically-diverged within the body.

The method further includes setting the plastic material and ejecting the puck from the mold, as is well known in the art The present invention is not intended to be limited to the embodiments described above, but to encompass any and all embodiments within the scope of the following claims.

I claim:

1. A puck in combination with a glide pin comprising:

a puck body having an upper face, an opposing lower face, and a plurality of throughbores interposed between said upper face and said lower face, each said throughbore having a predetermined throughbore diameter;

a plurality of split glide pins, each comprising a pair of mating components, each mating component including a head for preventing passage of said glide pin through said throughbore;

a shank member having a head end and a tip end and defining a longitudinal axis therebetween, said head end attached to said head, said shank member being tapered to define an inclined surface relative to said longitudinal axis, said inclined surface having a plurality of teeth;

wherein said shank members of said pair of mating components are engaged within said throughbore in a joined state which defines a shank of said glide pin, said shank having a predetermined shank diameter adjacent said head, said shank diameter being less than or equal to said throughbore diameter;

wherein further each said tip end has a tip diameter substantially less than said one-half of the throughbore diameter, wherein further a combined tip diameter is defined when said tip ends of said pair of mating components are engaged which is substantially less than the shank diameter; and wherein the longitudinal axis of each of said shank members of said pair of mating components are not aligned when engaged within said throughbore in a joined state.

2. The puck according to claim 1, wherein said pair of mating components define an engaged section having a diameter greater than said throughbore diameter.

3. A puck in combination with a glide pin comprising:

a puck body having an upper face, an opposing lower face, and a plurality of throughbores interposed between said upper face and said lower face, each said throughbore having a predetermined throughbore diameter;

a plurality of split glide pins, each comprising a pair of mating components, each mating component including a head for preventing passage of said glide pin through said throughbore;

a shank member having a head end and a tip end and defining a longitudinal axis therebetween, said head end attached to said head, said shank member being tapered to define an inclined surface relative to said longitudinal axis, said inclined surface having a plurality of teeth;

wherein said shank members of said pair of mating components are engaged within said throughbore in a joined state which defines a shank of said glide pin, said shank having a predetermined shank diameter adjacent said head, said shank diameter being less than or equal to said throughbore diameter;

wherein further each said tip end has a tip diameter substantially less than said one-half of the throughbore diameter, wherein further a combined tip diameter is defined when said tip ends of said pair of mating components are engaged which is substantially less than the shank diameter; and wherein said shank diameter is less than said throughbore diameter.

4. A puck in combination with a glide pin comprising;

a puck body having an upper face, an opposing lower face, and a plurality of throughbores interposed between said upper face and said lower face, each said throughbore having a predetermined throughbore diameter;

a plurality of split glide pins, each comprising a pair of mating components, each mating component including a head for preventing passage of said glide pin through said throughbore;

a shank member having a head end and a tip end and defining a longitudinal axis therebetween, said head end attached to said head, said shank member being tapered to define an inclined surface relative to said longitudinal axis, said inclined surface having a plurality of teeth;

wherein said shank members of said pair of mating components are engaged within said throughbore in a joined state which defines a shank of said glide pin, said shank having a predetermined shank diameter adjacent said head, said shank diameter being less than or equal to said throughbore diameter;

wherein further each said tip end has a tip diameter substantially less than said one-half of the throughbore diameter wherein further a combined tip diameter is defined when said tip ends of said pair of mating components are engaged which is substantially less than the shank diameter; and wherein said glide pin is allowed to be vertically displaced within said throughbore.

5. A puck in combination with a glide pin comprising:

a puck body having an upper face, an opposing lower face, and a plurality of throughbores interposed between said upper and said throughbore having a predetermined throughbore diameter;

a plurality of split glide pins, each comprising a pair of mating components, each mating component including:

a head for preventing passage of said glide pin through said throughbore;

a shank member having a head end and a tip end and defining a longitudinal axis therebetween, said head end attached to said head, said shank member having a plurality of teeth spaced and aligned along a diagonal incline relative to said longitudinal axis;

said shank member of said pair of mating components being engaged within said throughbore in a joined state which defines a shank of said glide pin, with said respective plurality of teeth of each shank member being engaged along said diagonal incline;

each head extending beyond the respective upper and lower faces of said puck body for forming a glide runner for said puck; and the distance between said opposing heads being slightly greater than the length of the throughbore to allow said glide pin to vertically move in said throughbore to dampen a fall of said puck.

6. A puck as defined in claim 5 further comprising:

the glide pin allowing displacement of one mating component with the other mating component along its plurality of teeth.

7. A puck in combination with a glide pin comprising:

a puck body having an upper face, an opposing lower face, and a plurality of throughbores interposed between said upper and said throughbore having a predetermined throughbore diameter;

a plurality of split glide pins, each comprising a pair of mating components, each mating component including:

a head for preventing passage of said glide pin through said throughbore;

a shank member having a head end and a tip end and defining a longitudinal axis therebetween, said head end attached to said head, said shank member having a plurality of teeth spaced and aligned along a diagonal incline relative to said longitudinal axis;

said shank member of said pair of mating components being engaged within said throughbore in a joined state which defines a shank of said glide pin, with said respective plurality of teeth of each shank member being engaged along said diagonal incline;

each head extending beyond the respective upper and lower faces of said puck body for forming a glide runner for said puck, a pair of opposing counterbores at each end of each throughbore for seating a respective head therein with said head extending beyond said counterbore and said respective upper or lower face; and the distance between said opposing heads being slightly greater than the length of the throughbore to allow said glide pin to vertically move in said throughbore to dampen a fall of said puck.

8. A puck as defined in claim 7 further comprising:

the glide pin allowing displacement of one mating component with the other mating component along its plurality of teeth.

9. The puck according to claim 7, wherein the longitudinal axis of each of said shank members of said pair of mating components are not aligned when engaged within said throughbore in a joined state.

10. A puck in combination with a glide pin comprising:

a puck body having an upper face, an opposing lower face, and a plurality of throughbores interposed between said upper and said throughbore having a predetermined throughbore diameter;

a plurality of split glide pins, each comprising a pair of mating components, each mating component including:

a head for preventing passage of said glide pin through said throughbore;

a shank member having a head end and a tip end and defining a longitudinal axis therebetween, said head end attached to said head, said shank member having a plurality of teeth spaced and aligned along a diagonal incline relative to said longitudinal axis;

said shank member of said pair of mating components being engaged within said throughbore in a joined state which defines a shank of said glide pin, with said respective plurality of teeth of each shank member being engaged along said diagonal incline;

each head extending beyond the respective upper and lower faces of said puck body for forming a glide runner for said puck; and wherein the longitudinal axis of each of said shank members of said pair of mating components are not aligned when engaged within said throughbore in a joined state.

* * * * *

UNITED STATES PATENT AND TRADEMARK OFFICE

CERTIFICATE OF CORRECTION

PATENT NO. : 6,277,042 B1
DATED : August 21, 2001
INVENTOR(S) : Lekavich, Carl

It is certified that error appears in the above-identified patent and that said Letters Patent is hereby corrected as shown below:

Column 1,
Line 67, before "potential" delete [an] and insert therein -- a --.

Column 2,
Line 52, before "tight" delete [an] and insert therein -- a --.

Column 3,
Line 48, after "McBee." delete [An] and insert therein -- A --.

Column 7,
Line 24, after "shanks" delete [38a, 38b] and insert therein -- 38A, 38B --.
Line 37, after "throughbore" delete [!].

Signed and Sealed this

Nineteenth Day of March, 2002

*Attest:*

*Attesting Officer*

JAMES E. ROGAN
*Director of the United States Patent and Trademark Office*